US010954062B2

(12) United States Patent
Collins

(10) Patent No.: US 10,954,062 B2
(45) Date of Patent: Mar. 23, 2021

(54) PACKAGE FOR SMOKING ARTICLES

(71) Applicant: JT International SA, Geneva (CH)

(72) Inventor: Tim Collins, Leatherhead Surrey (GB)

(73) Assignee: JT International SA

( * ) Notice: Subject to any disclaimer, the term of this patent is extended or adjusted under 35 U.S.C. 154(b) by 178 days.

(21) Appl. No.: 15/746,981

(22) PCT Filed: Jul. 19, 2016

(86) PCT No.: PCT/EP2016/067194

§ 371 (c)(1),
(2) Date: Jan. 23, 2018

(87) PCT Pub. No.: WO2017/016938

PCT Pub. Date: Feb. 2, 2017

(65) Prior Publication Data

US 2019/0009976 A1 Jan. 10, 2019

(30) Foreign Application Priority Data

Jul. 27, 2015 (EP) ..... 15178524

(51) Int. Cl.
*B65D 85/10* (2006.01)
*B65D 5/66* (2006.01)

(52) U.S. Cl.
CPC ..... *B65D 85/1045* (2013.01); *B65D 5/662* (2013.01); *B65D 5/6608* (2013.01)

(58) Field of Classification Search
CPC .. B65D 85/1045; B65D 5/6608; B65D 5/662; B65D 5/6691; B65D 5/4291; B65D 2203/12

(Continued)

(56) References Cited

U.S. PATENT DOCUMENTS 1,433,439 A * 10/1922 Weis ..... B65D 5/0254 229/149
3,326,447 A * 6/1967 Williamson ..... B65D 5/6667 229/125.08

(Continued)

FOREIGN PATENT DOCUMENTS

DE 102012014845 A1 * 5/2014 ..... B65D 85/10
DE 102012014845 A1 5/2014

(Continued)

OTHER PUBLICATIONS

International Search Report dated Sep. 22, 2016, issued in corresponding International Application No. PCT/EP2016/067194.

*Primary Examiner* — Luan K Bui
(74) *Attorney, Agent, or Firm* — Lerner, David, Littenberg, Krumholz & Mentlik, LLP

(57) ABSTRACT

A package for storing smoking articles includes a body having a plurality of walls defining a volume, including a front wall and a rear wall, and an opening; a lid for closing the opening and having a plurality of walls and being hinged on the rear wall, allowing the lid to be moved between closed and open positions; a locking tab; and an engagement recess for engaging the locking tab when the lid is in the closed position. The locking tab is connected to one of either the front wall of the body or an inner side of a front wall of the lid, and the engagement recess is located on the other one. The locking tab and the engagement recess each have a respective engagement edge for mutual engagement. The engagement edge of at least one of the locking tab and the engagement recess follows a curved line.

11 Claims, 9 Drawing Sheets

(58) Field of Classification Search
USPC ..... 206/268, 266, 270, 271, 273; 229/146, 229/148, 149, 160.1
See application file for complete search history.

(56) References Cited

U.S. PATENT DOCUMENTS

| | | | | |
|---|---|---|---|---|
| 3,664,572 | A * | 5/1972 | Puchkoff et al. | B65D 5/18 229/103.2 |
| 5,123,589 | A * | 6/1992 | Cote | B65D 5/545 206/455 |
| 5,896,984 | A * | 4/1999 | Focke | B65D 85/1045 206/268 |
| 6,334,532 | B1 * | 1/2002 | Tambo | B65D 85/1045 206/268 |
| 6,719,131 | B1 * | 4/2004 | Focke | B65D 5/6691 206/268 |
| 7,527,189 | B2 * | 5/2009 | Billig | B65D 83/0876 229/149 |
| 8,783,454 | B2 * | 7/2014 | Igo | B65D 75/5838 206/242 |
| 8,875,878 | B2 * | 11/2014 | Young | A24F 15/12 206/268 |
| 2009/0001145 | A1 * | 1/2009 | Hasse | B65D 5/662 229/117.12 |
| 2009/0288966 | A1 * | 11/2009 | Minarelli | B65D 5/6608 206/268 |
| 2014/0021078 | A1 * | 1/2014 | Holford | B65D 5/4291 206/268 |
| 2017/0152094 | A1 * | 6/2017 | Holford | B65D 75/5838 |

FOREIGN PATENT DOCUMENTS

| | | | | |
|---|---|---|---|---|
| WO | 93/01095 | A1 | 1/1993 | |
| WO | WO-2008010041 | A1 * | 1/2008 | B65D 5/6608 |
| WO | 2012/049701 | A2 | 4/2012 | |

* cited by examiner

PACKAGE FOR SMOKING ARTICLES

CROSS-REFERENCE TO RELATED APPLICATIONS

The present application is a national phase entry under 35 U.S.C. § 371 of International Application No. PCT/EP2016/067194 filed Jul. 19, 2016, published in English, which claims priority from European Patent Application No. 15178524.3 filed Jul. 27, 2015, all of which are incorporated herein by reference.

FIELD OF THE INVENTION

The present invention relates to a package for smoking articles. In particular, the invention relates to packages for cigarettes or other consumable products which have a hinged lid and which may be folded from a blank made of card or another substantially planar semi-flexible material capable of being folded to form a boxed shaped container. Such packages may be referred to as hinged-lid type packages.

BACKGROUND OF THE INVENTION

Boxed shaped containers having a hinged lid for containing cigarettes are well known in the art and numerous different examples have been proposed in the past. These are often folded from cardboard blanks to form a cardboard pack having a hinged lid which may be opened to allow access to the contents and closed again to protect the contents during transport, when in the pocket of a user's garment for example.

Such cardboard packages (or packs) may suffer some deformation during use and due to this deformation and/or due to general disturbance of the pack in use, the lid may tend to at least partially open at times when the user wishes the lid to remain closed. This can result in damage to the contents of the pack and can result in the contents of the pack escaping from the pack in an undesirable manner. This phenomenon may be referred to as "smiling", where the hinged lid of the pack sits slightly open with respect to the body of the pack. When carried in a garment, in particular where the pack is a cigarette pack, loose tobacco contained in the pack can find its way into the user's pocket through the aperture created by this "smiling" effect.

Packs including a lid locking mechanism have been proposed in the past/One such pack has a tongue mounted to a front wall of the pack which is rotatable about a hinge at the base of the tongue. The tongue is configured to engage with an engaging part on the inner front wall of the lid of the pack, which has a gap, the gap being formed between the inner wall of the lid and a tab folded on to the inner wall. As the lid of the pack is rocked toward an open position, the tongue enters the gap and resists the opening of the pack. This prior configuration has some drawbacks, in that the forces required to disengage the tongue from the gap can create stresses in the hinge at the base of the tongue, as well as between the inner front wall of the lid and the tab creating the gap. Further the prior locking mechanisms only engage once the lid is partially rocked toward the open position and so only hold the lid partially closed and do not completely resolve the "smiling" problem. Additionally, the prior locking mechanisms can result in sudden changes in force occurring during the opening of the lid, which can cause a shock to the hinge at the base of the tongue and result in increased wear and/or damage to the hinge at the base of the tongue, substantially reducing the lifespan of the locking mechanism. Furthermore, the locking mechanisms involved in such packages, can snag the smoking articles when the lid is being closed, causing tearing and deformation of the smoking articles.

Accordingly, there is a clear need for a container having an improved locking mechanism for maintaining the lid in a closed configuration.

SUMMARY OF THE INVENTION

According to a first aspect of the invention, there is provided a package for storing smoking articles, the package comprising: a body comprising a plurality of walls defining a volume for storing the smoking articles, including a front wall and a rear wall substantially opposite the front wall, and an opening for accessing the volume and inserting or removing any smoking articles stored therein; a lid for closing the opening of the body, the lid comprising a plurality of walls and being hinged on the rear wall of the body, allowing the lid to be moved between a closed position and an open position; a locking tab; an engagement recess for engaging with the locking tab when the lid is in the closed position; wherein the locking tab is connected to one of either (a) the front wall of the body of the package or (b) an inner side of a front wall of the lid, and the engagement recess is located on the other one of either (a) the front wall of the body of the package, or (b) the inner side of the front wall of the lid; and wherein the locking tab and the engagement recess each have a respective engagement edge for mutual engagement between the locking tab and the engagement recess, wherein the engagement edge of at least one of the locking tab and the engagement recess follows a curved line.

In some embodiments of the invention, the engagement edge of both the locking tab and the engagement recess follow a curved line.

In some embodiments of the invention, the engagement edge of the engagement recess follows a first curved line and the engagement edge of the locking tab follows a second curved line which is parallel to and offset in a longitudinal direction of the package from the first curved line when the lid is in the closed position.

In some embodiments of the invention, the engagement edge of the locking tab may be inscribed in a first ellipse.

In some embodiments of the invention, each end of the engagement edge is located at a different respective end of a major axis of the first ellipse and the locking tab hinge extends along the major axis of the first ellipse.

In some embodiments of the invention, the engagement edge of the engagement recess may be inscribed in a second ellipse.

In some embodiments of the invention, the engagement edge of the engagement recess extends along at least half of the second ellipse between vertices on a major axis of the second ellipse and wherein the major axis of the second ellipse is parallel to the locking tab hinge when the lid is in the closed position.

In some embodiments of the invention, the engagement edge of the engagement recess extends to, and is fully delimited by, the second ellipse.

In some embodiments of the invention, the locking tab and engagement recess are arranged such that, when the lid is in the closed position, the major axis of the first ellipse is coaxial and smaller than the major axis of the second ellipse.

In some embodiments of the invention, the locking tab is located on the front wall of the body and connected to the front wall of the body by a fold line and wherein the engagement recess is located on an inner side of the front wall of the lid.

In some embodiments of the invention, the engagement recess is located on the front wall of the body and is formed by a cut-out therein and wherein the locking tab is formed on an inner side of the front wall of the lid.

In some embodiments of the invention, the locking tab and engagement recess are arranged such that the locking tab fits into the engagement recess in the closed position of the lid and engages with the engagement recess in a hooking fashion upon opening of the lid towards the open position.

In some embodiments of the invention, the package comprises an inner frame and wherein the front wall of the body of the package comprises a front wall of the inner frame.

According to a second aspect of the invention, there is provided a blank or set of blanks for forming the package according to the first aspect, the blank or set of blanks comprising: a plurality of panels for forming the walls of the body and the lid of the package, including a front wall panel for forming the front wall of the body and a rear wall panel for forming the rear wall of the body substantially opposite the front wall of the body; a crease line for forming a hinged connection between the lid and a panel for forming the rear wall of the body of the package, the hinged connection allowing the lid to be moved between a closed position and an open position; wherein the locking tab is formed on one of either (a) the front wall panel of the body of the package or (b) a panel for forming the inner side of the front wall of the lid, and the engagement recess is formed on the other one of either (a) the front wall of the body of the package, or (b) the inner side of the front wall of the lid; and wherein the locking tab and the engagement recess are located to allow mutual engagement between the respective engagement edges of the locking tab and the engagement recess and are formed such that the engagement edge of at least one of the locking tab and the engagement recess follows a curved line.

According to a third aspect of the invention, there is provided a method of forming the package according to the first aspect by folding the blank or blanks according to the second aspect.

BRIEF DESCRIPTION OF THE DRAWINGS

Specific embodiments of the present invention will now be described, by way of example only, with reference to the accompanying drawings in which.

DETAILED DESCRIPTION OF EMBODIMENTS OF THE INVENTION

Figure 1A:
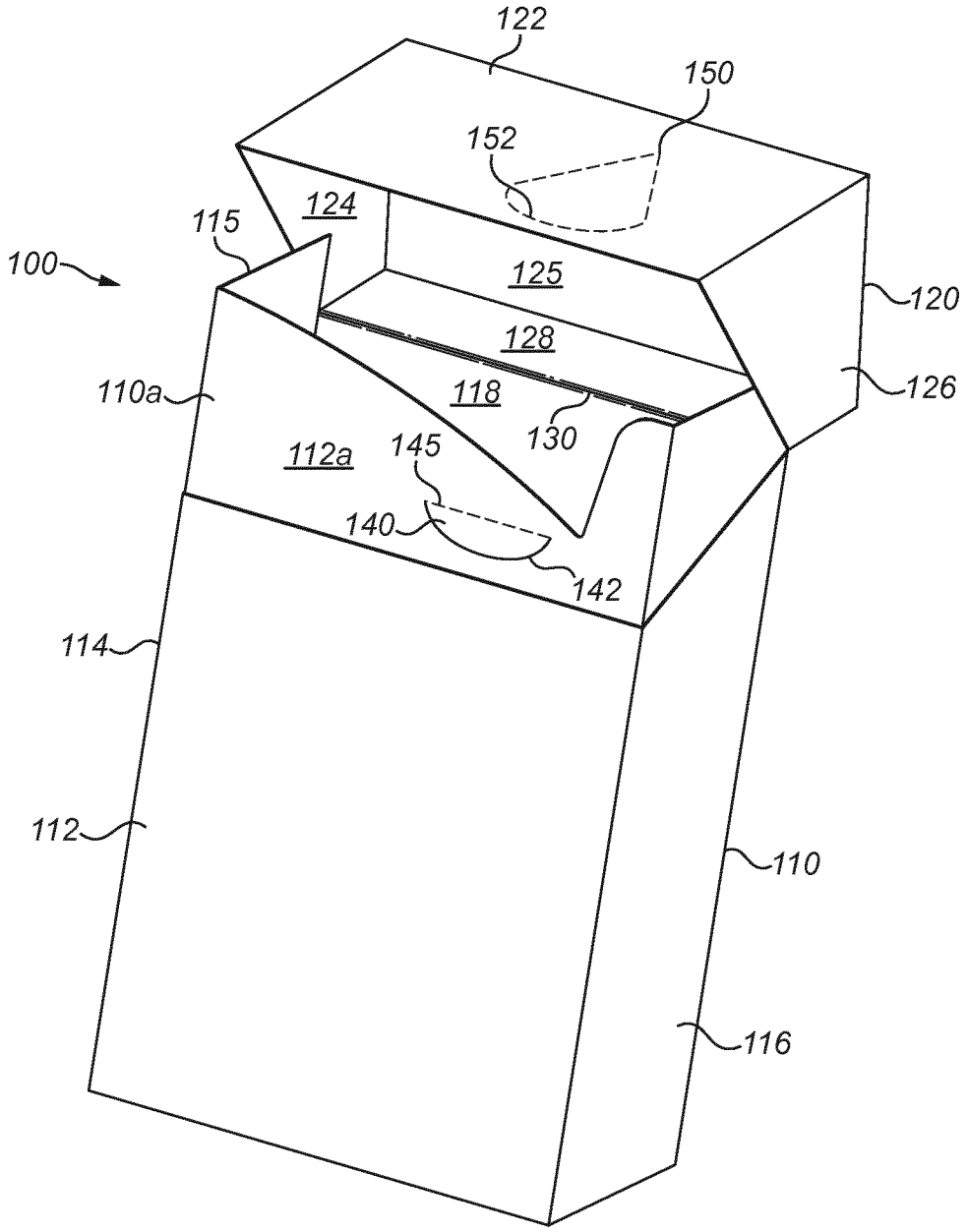
FIG. 1A is a perspective view of a package for smoking articles in accordance with the present invention.
Figure 1B:
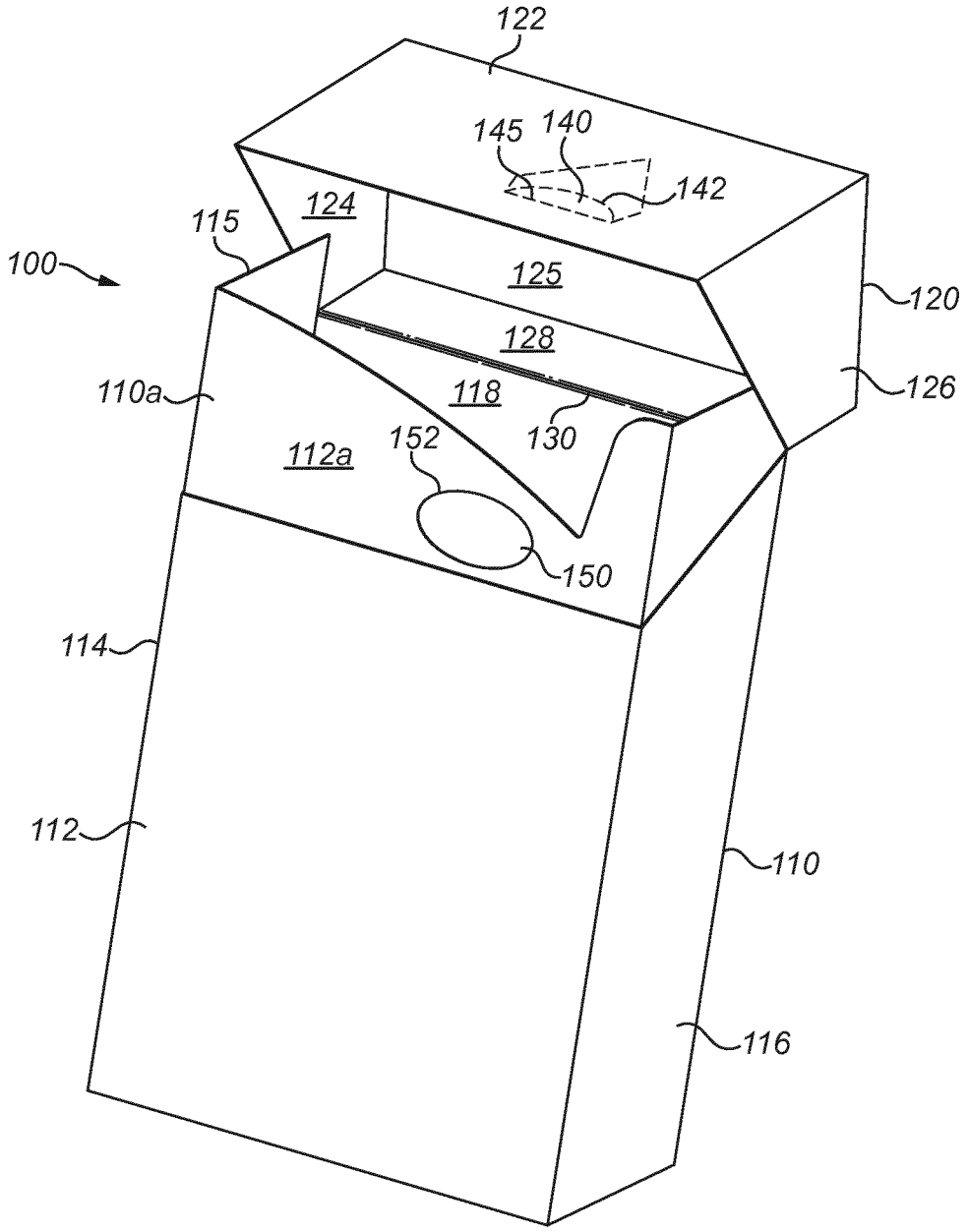
FIG. 1B is a perspective view of an alternative package for smoking articles in accordance with the present invention.

FIGS. 1A and 1B show packages (or packs or boxes or containers) 100 for smoking articles in accordance with the present invention. Although the package 100 illustrated by FIGS. 1A and 1B differ slightly from each other, each of the packages 100 comprises a body 110, a lid 120, a lid-hinge 130, a locking tab 140 and an engagement recess 150.

The body 110 comprises a plurality of walls 112, 114, 116 and 118, a bottom end wall (not shown) and an open top end 115. One of the walls forms a front wall 112 of the body 110, whilst another of the walls forms a rear wall 118 of the body 110. The front wall 112 of the body 110 is substantially opposite the rear wall 118 of the body 110, but need not necessarily be precisely opposite and parallel to the rear wall 118 of the body 110. The remaining walls form side walls 114 and 116 connecting the front wall 112 to the rear wall 118. Any number of side walls may be disposed in series between the front wall 112 and the rear wall 118 of the body 110 to form a package 100 of a desired shape. For example, as an alternative to the form illustrated in FIGS. 1A and 1B, where a single pair of opposing side walls 114 and 116 is provided to give the pack a regular box-shaped form, a plurality of side walls may be provided to give the pack a substantially oval-shaped form when viewed from the bottom (i.e. looking up at the bottom end wall of the body 110) or when viewed from the top (i.e. looking down into the open top end 115 of the body 110). Other numbers of side walls 114 and 116 may be provided to form other outer shapes of the body 110 as appropriate.

The lid 120 is provided to close (or cover) the open top end 115 of the body 110. The lid 120 comprises a plurality of side walls 122, 124, 126 and 128, as well as a top wall 125. One of the side walls forms a front wall 122 of the lid 120. Optionally, one of the side walls may form a rear wall 128 of the lid 120, however this is not essential. Where the lid 120 comprises a rear wall 128, the front wall 122 of the lid 120 is substantially opposite the rear wall 128 of the lid 120, but need not necessarily be precisely opposite and parallel to the rear wall 118 of the body 110.

The lid hinge 130 hingeably connects the lid 120 to the body 110 of the package 100. The lid hinge 130 may, optionally, be formed between the rear wall 128 of the lid 120 and the rear wall 118 of the body 110. However, the rear wall 128 of the lid 120 is not essential and the lid hinge 130 may instead, optionally, be formed directly between the rear wall 118 of the body 110 and the top wall 125 of the lid 120. In either case, the hinge 130 is disposed on the side of the lid 120 that is substantially opposite the front wall 122 of the lid 120. The lid hinge 130 allows the lid 120 to rotate about the lid hinge 130 allowing the lid 120 to move between a closed position in which the lid 120 closes the top end 115 of the body 110 and an open position in which the lid 120 does not close the top end 115 of the body 110.

The locking tab 140 comprises an engagement edge 142 for engaging with the engagement recess 150 when the lid 120 of the package is in the closed position. The locking tab 140 is hingeably attached (or connected) to the package 100 via a locking tab hinge 145. A base of the locking tab 140 is adjacent the tab hinge 145 and a tip of the locking tab is distal to the tab hinge 145. The locking tab 140 may be located on the front side of the body 110 of the package 100, for example in the front wall 112 of the body 110 of the package 100 and preferably in the front wall of an inner frame 112*a* extending from the front wall 112 of the body in the open top end thereof (as illustrated in FIG. 1A) or, alternatively, to an inner side of the front wall 122 of the lid 120 of the package 100 (as illustrated in FIG. 1B). The locking tab hinge 145 allows the locking tab 140 to rotate relative to the package 100 about the locking tab hinge 145.

The engagement recess 150 comprises an engagement edge 152 for engaging with the locking tab 140 when the lid 120 of the package 100 is in the closed position. Where the locking tab 140 is attached to the front wall 112 or inner frame 112*a* of the body 110 of the package 100, the engagement recess 150 is located on the inner side of the front wall 122 of the lid 120 of the package 100 (as illustrated in FIG. 1A). Alternatively, where the locking tab 140 is attached to the inner side of the front wall 122 of the lid 120 of the package 100, the engagement recess 150 is located on the front wall 112 or inner frame 112*a* of the body of the package 100 (as illustrated in FIG. 1B).

It will be appreciated that references to the inner side, or back, of a wall are generally intended to refer to the side of the wall that is inside the package 100 and is not normally visible when the lid 120 of the package 100 is in the closed position. In the figures, dashed lines have been used to show those features which would not normally be visible from a particular viewpoint, such as the features on the other side of a wall of the package.

At least one, preferably both, of the respective engagement edges 142 and 152 of the locking tab 140 and the engagement recess 150 follows a curved line. In other words, at least one of the respective engagement edges 142 and 152 of the locking tab 140 and the engagement recess 150 does not follow a straight line nor comprise any linear segment. Preferably, both the engagement edge 142 of the locking tab 140 and the engagement recess 150 follow curved lines which may be similar or different from each other. The engagement edge 152 of the engagement recess 150 may follow a first curved line, whilst the engagement edge 142 of the locking tab 140 may follow a second curved line which is parallel to and offset from the first curved line when the lid is in the closed position. The curved line followed by the engagement edge of either the locking tab 140 or the engagement recess 150 or both, may at least partially follow the outline of a regular shape, such as any form of ellipse. In other words, the curved line followed by the engagement edge 142 of the locking tab 140 and/or the engagement edge of the engagement recess 150 may be inscribed in a respective ellipse (i.e. the engagement edge of the locking tab may be inscribed in a first ellipse and/or the engagement edge of the engagement recess may be inscribed in a second ellipse). The respective ellipses in which the engagement edges 142 and 152 of the locking tab 140 and/or the engagement recess 150 may be inscribed may be the same ellipse or may be different ellipses. Similarly, the center point of the respective ellipses in which the engagement edges 142 and 152 of the locking tab 140 and/or the engagement recess 150 may be inscribed may overlap one another (i.e. the major axes of both ellipses may be parallel or coaxial) when the lid 120 is in the closed position, or, alternatively, may be offset in a longitudinal direction. The dimensions of the major axes of the respective ellipses in which the engagement edges 142 and 152 of the locking tab 140 and/or the engagement recess 150 may be inscribed, may differ in length. For example, the length of the major axis of a first ellipse in which the engagement edge 142 of the locking tab 140 may be inscribed may be smaller than the major axis of the second ellipse. Where the engagement edge 142 of the locking tab 140 may be inscribed in a first ellipse, the ends of the engagement edge 142 may be located at the two different ends of the major axis (i.e. the longest diameter) of the first ellipse and the locking tab hinge may extend along the major axis of the first ellipse, resulting in a semi-elliptical locking tab 140. Where the engagement edge 152 of the engagement recess 150 may be inscribed in a second ellipse, the major axis of the second ellipse may be parallel to the locking tab hinge 145 and the engagement edge 152 may extend along at least half of the second ellipse and, optionally, may extend to the full extent of the second ellipse (i.e. so that the engagement recess 150 is fully delimited by the second ellipse).

As previously described, the package 100 may preferably comprise an inner frame 110*a* which is situated towards the top of the body 110 of the package 100 about the open top end 115 (as shown in FIGS. 1A and 1B). The inner frame 110*a* may comprise a plurality of walls, including a front wall 112*a*. A front wall of the package 100, may therefore be formed from a combination of the front wall 112 of the body 110 of the package 100 and the front wall 112*a* of the inner frame 110*a* of the package. The inner frame 110*a* need not completely encircle the open top end 115 of the package 100. The inner frame 110*a* may be angled slightly inwards, towards the interior of the pack, which can help to grip the products within the package 100. Where the package 100 comprises such an inner frame 110*a*, either the locking tab 140 or the engagement recess 150 may be located on (i.e. attached to or formed on) the front wall 112*a* of the inner frame 110*a* instead of the front wall 112 of the body 110 of the package 100. However, an inner frame 110*a* is not essential for packages 100 of the present invention.

Whilst the positioning of the of the locking tab 140 and the engagement recess 150 on the package 100 may be swapped around, as illustrated by the two different FIGS. 1A and 1B, it will be appreciated that the packages are otherwise the same.

Figure 2A:
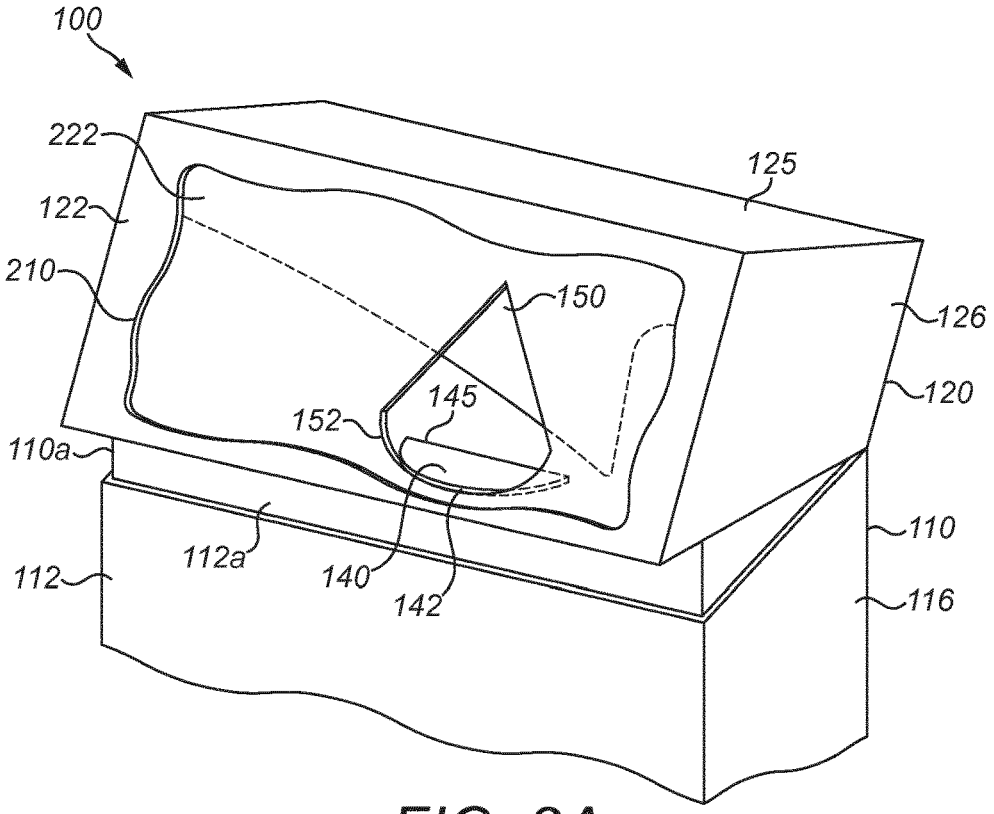
FIG. 2A is a perspective view of the top end of the package for smoking articles of FIG. 1A showing the locking mechanism in more detail.
Figure 2B:
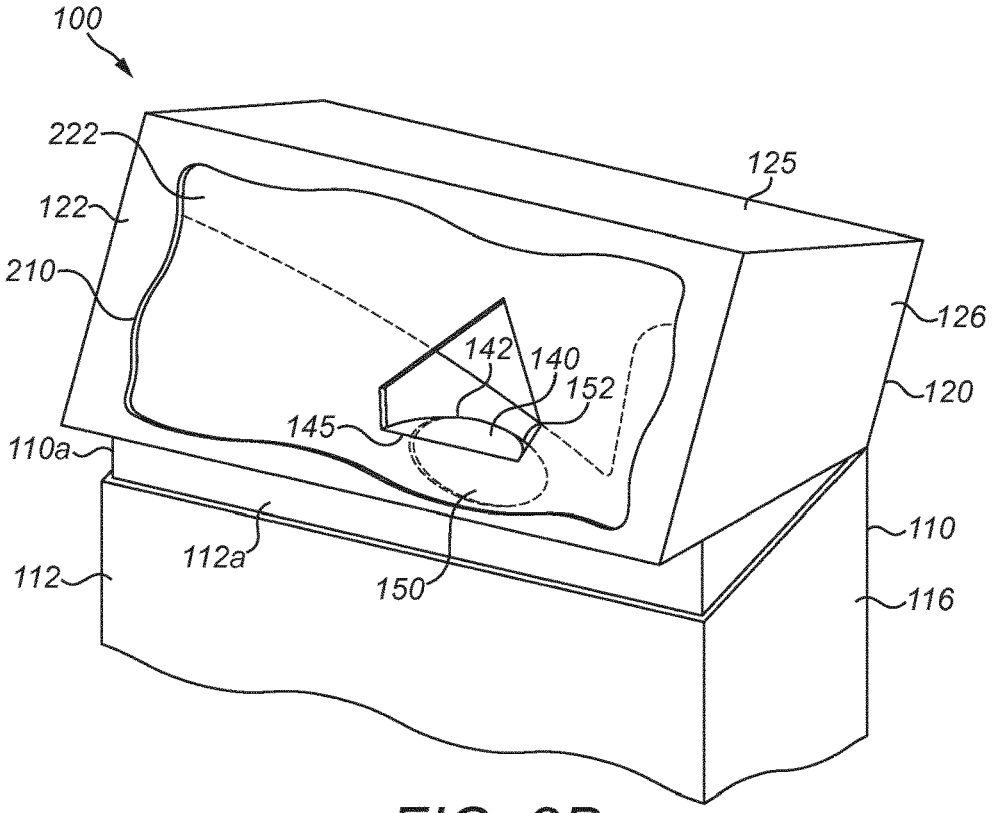
FIG. 2B is a perspective view of the top end of the package for smoking articles of FIG. 1B showing the locking mechanism in more detail.

FIGS. 2A and 2B illustrate perspective views of the top end of the packages 100 of the present invention. In these views of the package 100, a portion 202 of the front wall 122 of the lid 120 of the package 100 has been cut-away to more clearly show the mutual engagement between the locking tab 140 and the engagement recess 150. It will be appreciated that this cut-away portion 202 is included merely for the purpose of illustration and that such a cut-away portion 202 is preferably not present in the assembled package 100. In the perspective views illustrated by FIGS. 2A and 2B, the lid 120 of the package 100 is positioned in a partially open position in which the locking mechanism formed by the locking tab 140 and the engagement recess 150 is at a limit of its operation. This limit of operation of the locking mechanism is reached during the opening of the lid 120 when the engagement between the locking tab 140 and the engagement recess 150 is at its final stages, just prior to disengagement of the locking mechanism.

As shown in FIGS. 2A and 2B, the front wall 122 of the lid 120 of the package 100 may comprise more than one layer. Preferably, the front wall 122 of the lid 120 is formed from two separate layers of material, such that the front wall 122 comprises an outer layer and an inner layer 222. FIGS.

2A and 2B show such an inner layer 222 located behind an outer layer of the front wall 122 of the lid 120 and revealed by the cut-away portion 210 of the front wall 122 of the lid 120. The outline of the top of the inner frame 110*a* of the package 100 has been illustrated using dashed lines in FIGS. 2A and 2B to show that it is behind this inner layer 222 of the front wall 122 (and therefore would not normally be visible even in the presence of the cutaway portion 210). Where the front wall 122 of the lid 120 of the package 100 comprises more than one layer, the layers need not be layered flush with one another and there may be air gaps or pockets left between the layers, at least in certain portions or areas of the front wall 122. For example, where the engagement recess is located on the inner side of the front wall 122 of the lid 120, a gap may be created between the inner layer 222 and the outer layer of the front wall 122 of the lid 120. This gap may be large enough to accommodate at least part of the locking tab 140 during the mutual engagement between the locking tab and the engagement recess 150. Allowing the locking tab 140 access to this gap may provide a more positive locking effect of the locking mechanism. However, the front wall 122 of the lid 120 of the package 100 need not comprise more than one layer and may instead consist of a single layer of material.

The process of engaging the locking mechanism occurs when the lid 120 is moved from an open position to a closed position. During the closing of the lid, the locking tab 140 starts disengaged from the engagement recess 150. As the lid 120 is closed, the locking tab 140 is displaced, offering little resistance to the closing of the package 100. For example, if the locking tab 140 is mounted on a front wall 122 of the package 100 (as shown in FIGS. 1A and 2A), the inner side of the front wall 122 of the lid 120 pushes the locking tab 140 downwards towards the front wall of the package 100 on which it is mounted. Alternatively, if the locking tab 140 is mounted on an inner side of the front wall 122 of the lid 120, the front wall 112 of the body 110 of the package 100 (and/or the front wall 112*a* of the inner frame 110*a*) pushes the locking tab 140 upwards towards the front wall 122 of the lid 120 on which it is mounted. As a result, the locking tab 140 does not engage with the engagement recess 150 until the lid is substantially in the closed position, at which point the locking tab 140 is substantially aligned with the engagement recess 150. With the lid in this position, the locking tab 140 may, at least partially, enter the engagement recess 150 thereby mutually engaging with it. At this point, the locking mechanism of the package 100 is engaged. To assist with the engagement of the locking mechanism, the locking tab 140 may be biased away from the part of the package 100 to which it is attached. For example, where the locking tab 140 is located on a front wall 112 of the body 110 of the package 100 (as illustrated in FIGS. 1A and 2A), the locking tab 140 may be biased away from body of the package. Alternatively, where the locking tab 140 is located on an inner side of the front wall 122 of the lid 120 of the package 100 (as illustrated in FIGS. 1B and 2B), the locking tab 140 may be biased inwards from the inner side of the front wall 122 of the lid 120 towards the body 110 of the package. This biasing of the locking tab 140 aids the engagement between the locking tab 140 and the engagement recess 150 by biasing the locking tab 140 into the engagement recess 150 when the lid 120 is in the closed position. The greater the bias, the more immediately and effectively the locking tab will engage with the engagement portion. The engagement of the locking tab 140 with the engagement recess 150 results in an audible and/or tactile clicking, providing the user with feedback that the locking mechanism has been engaged and that the lid 120 is now secured. This locking mechanism therefore helps to prevent accidental opening of the package and also helps to prevent the "smiling" effect mentioned above.

The locking tab 140 and the engagement recess 150 are orientated in such a manner that allow the lid 120 to easily displace the locking tab 140 when the lid 120 is moved from an open position to a closed position, but which causes the locking tab 140 to latch onto the engagement recess 150 when the lid 120 is moved from the closed position into an open position. Where the locking tab 140 is located on a front wall of the body 110 of the package 100, the locking tab 140 is oriented with the tip of the locking tab 140 directed away from the open top end 115 of the body 110 of the package (i.e. with the base of the locking tab 140 closest to the open top end 115). Conversely, where the locking tab 140 is located on an inner side of the front wall 122 of the lid 120, the locking tab 140 is orientated with the tip of the locking tab 140 directed towards the top wall 125 of the lid 120 of the package 100 (i.e. with the base of the locking tab 140 closest to the point where the lid 120 meets the body 110 of the package). Due to the latching (or hooking) caused by the mutual engagement between the locking tab 140 and the engagement recess 150, it is necessary for the locking tab 140 to be rotated at the same time that the lid 120 is opened. This requires the lid 120 to be opened with a rocking motion which causes the locking tab 140 to be rotated in the necessary manner. Furthermore, this latching causes the lid 120 to be biased towards the closed position, up until the point where the locking mechanism disengages, when the lid is partially opened. In order to move the lid 120 in the rocking motion to the point where the locking mechanism is disengaged, the user must provide sufficient force, through the lid 120 to overcome this bias. The force provided by the user to move the lid is transferred to the locking tab 140 via points of contact (otherwise referred to as contact points) that exist between the respective engagement edges 142 and 152 of the locking tab 140 and the engagement recess 150. The contact points between the locking tab and the engagement recess 150 are located away from the locking tab hinge 145, resulting in a moment being exerted about the locking tab hinge 145. Due to the curved shape of at least one of the engagement edges 142 and 152 of the locking tab 140 and the engagement recess 150 respectively, the location of the contact points between the engagement edges 142 and 152 moves during the rotation of the locking tab 140 whilst the lid 120 is being opened. In particular, at the start of opening the lid 120 (i.e. when the lid 120 is substantially in the closed position), the contact points between the locking tab 140 and the engagement recess 150 are toward the base of the locking tab 140. During the movement of the lid 120 towards an open position, the contact points between the locking tab 140 and the engagement recess 150 move along the engagement edges 142 and 152 to a point that is towards the tip of the locking tab 140. That is to say, at the start of the opening of the lid 120 of the package 100, the contact points are closer to the base of the locking tab 140, whilst at the point just prior to the locking mechanism being disengaged, the contact points are closer to the tip of the locking tab 140. Due to the curved shape of at least one of the engagement edges 142 and 152, the rate at which the contact points move away from the locking tab hinge 145 during the opening of the lid 120 changes at differing rates throughout the movement, the change in the rate varying smoothly according to the gradient of the curve at each point. Since the distance of the contact points from the locking tab hinge 145 defines the moment that is provided by the lid opening force on the locking tab 140, the force required to rotate the locking tab 140 decreases over the course of the movement as the location of the contact points slides further away from the locking tab hinge 145. This means that the force that a user must apply to open the lid 120 of the package 100 is greatest during the initial stages of the movement and tails off at a decreasing rate as the lid is opened until the point that the locking mechanism is disengaged. The smoothly varying change in force provides the user with tactile feedback as to the current progress of the lid 120 opening operation, resulting in a better user experience. Additionally, because a larger force is required to overcome the initial stages of the locking mechanism, the likelihood of the lid 120 being accidentally opened is reduced. Furthermore, because the force required to rotate the engagement tab 140 changes smoothly throughout the lid 120 opening or closing operation, there are no sudden changes (or step changes) in force which can cause a shock to the locking tab hinge 145 which may result in increased wear and/or damage to the locking tab hinge 145. Preferably, the curved shape of at least one of the engagement edges 142 and 152 of the locking tab 140 and the engagement recess 150 respectively follows an elliptical shape having the major axis extending parallel to the lid hinge (i.e. in the case of the locking tab 140 along the locking tab hinge 145) as this achieves a smooth progressive opening of the lock due to the continuous curvature of this long edge of the ellipse whilst ensuring a secure locking effect when the lid is closed.

Figure 3A:
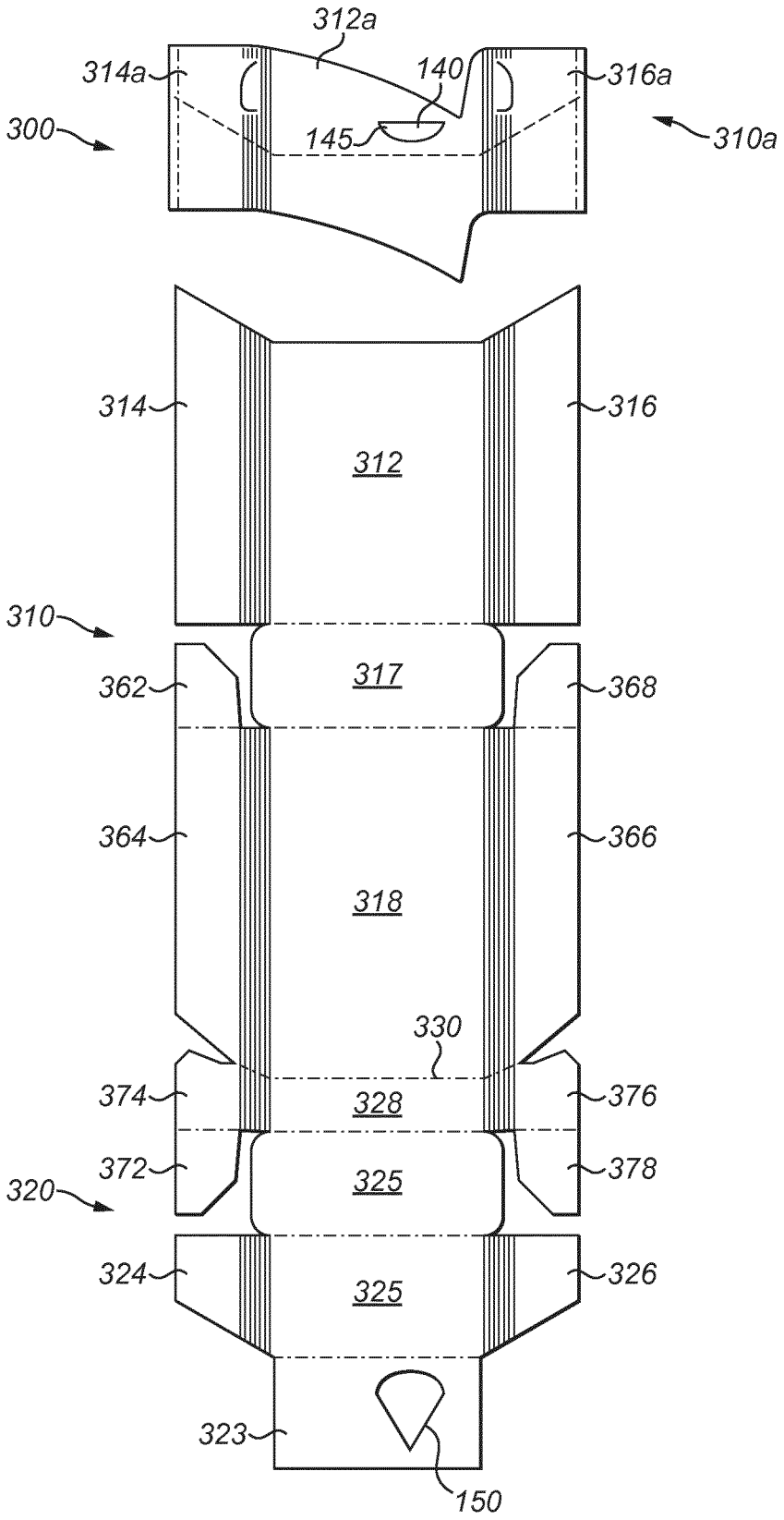
FIG. 3A schematically illustrates blanks which may be used to form the package of FIGS. 1A and 2A.
Figure 3B:
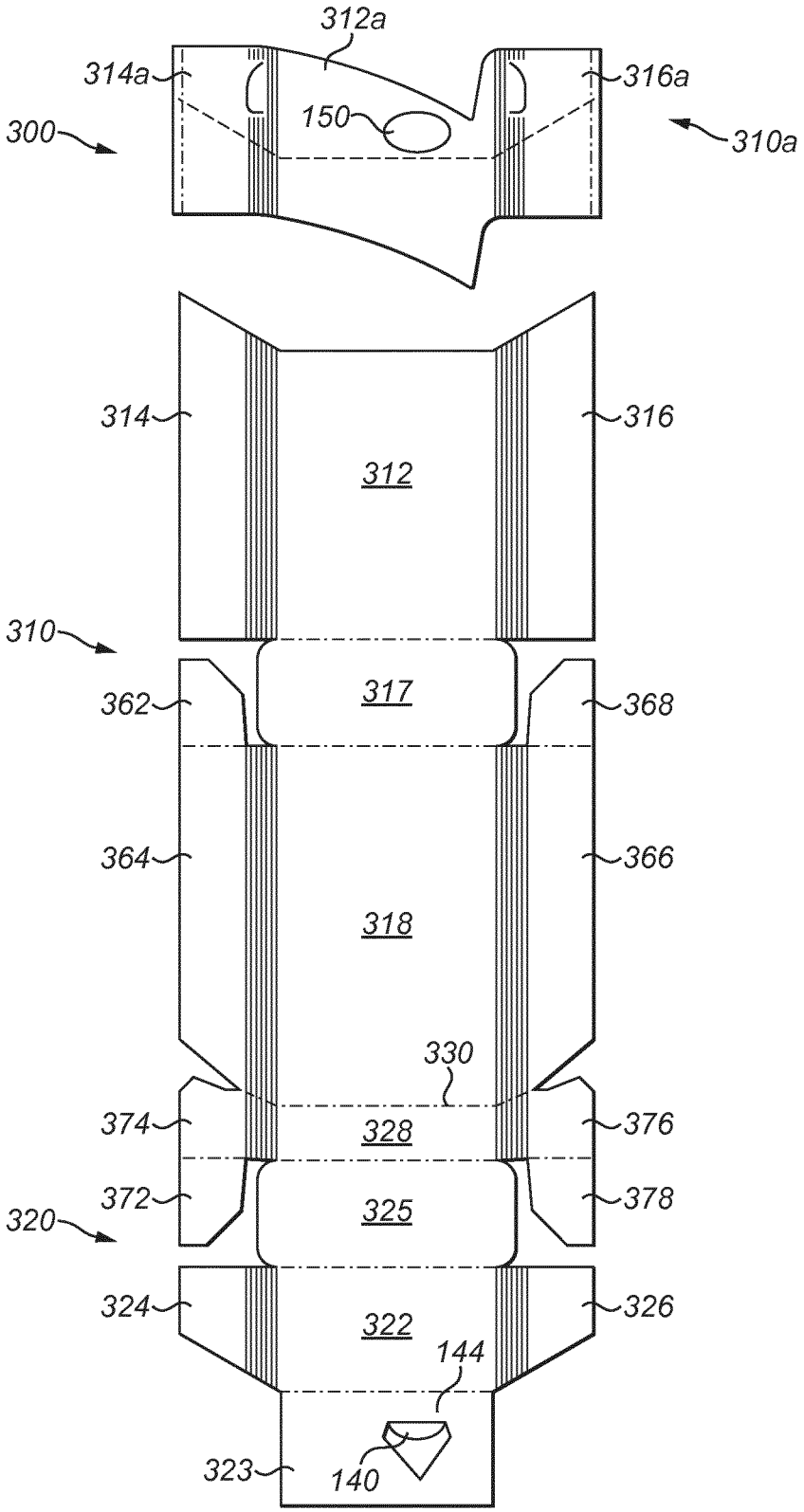
FIG. 3B schematically illustrates blanks which may be used to form the package of FIGS. 1B and 2B.

FIGS. 3A and 3B illustrate blanks 300 which may be used to form the packages 100 of the present invention, as illustrated in FIGS. 1A and 1B respectively (i.e. the blanks 300 illustrated by FIG. 3A may be used to form the package 100 shown in figured 1A and 2A, whilst the blanks 300 illustrated by FIG. 3B may be used to form the package 100 shown in FIGS. 1B and 2B). The blanks 300 comprise a first portion 310 for forming the body 110 of the package 100 and a second portion 320 for forming the lid 120 of the package 100.

The first portion 310 of the blanks 300 comprises a plurality of panels including, a body front wall panel 312 for forming the front wall 112 of the body 110, a first body side wall panel 314 for forming one of the intermediate side walls 114 of the body 110, a second body side wall panel 316 for forming another one of the intermediate side walls 114 of the body 110, a body bottom wall panel 317 for forming the bottom end wall of the body 110, and a body rear wall panel 318 for forming the rear wall 118 of the body 110. The body front wall panel 312 is connected to the first body side wall panel 314 by a fold line on one side of the panel and to the second body side wall panel 316 by a fold line on the opposite side of the body front wall panel 312. The body front wall panel 312 is further connected to the body bottom wall panel 317 by a fold line on another side of the panel. The body bottom wall panel 317 is connected to the body rear wall panel 318 by a fold line on a side of the body bottom pane 317 which is opposite from the fold line connecting the body bottom wall panel 317 to the body front wall panel 312. The first portion 310 of the blanks 300 further comprises a plurality of tabs including a first body side wall tab 364, a first body side bottom wall tab 362, a second body side wall tab 366 and a second body side bottom wall tab 368. The first and second body side wall tabs 364 and 366 are connected to the body rear wall panel 318 by respective fold lines on opposite sides of the body rear wall panel 318. The first body side bottom wall tab 362 is connected via a fold line to the first body side wall tab 364. The second body side bottom wall tab 368 is connected via a fold line to the second body side wall tab 366.

The second portion 320 of the blanks 300 comprises a plurality of panels, including a lid front wall panel 322 for forming the front wall 122 of the lid 120, a first lid side wall panel 324 for forming one of the side walls 124 of the lid 120, a second lid side wall panel 326 for forming another of the side walls 126 of the lid 120 and a lid top wall panel 325 for forming the top wall 125 of the lid 120. The lid front wall panel 322 is connected to first lid side wall panel 324 by a fold line on one side of the panel and to the second lid side wall panel 326 by a fold line on the opposite side of the panel. The lid front wall panel 322 is further connected to the lid top wall panel 325 by a fold line on another side of the lid front wall panel 322. Optionally, the second portion 320 may comprise a lid rear wall panel 328 which is connected to the lid top wall panel 325 by a fold line on a side of the lid top wall panel 325 which is opposite from the fold line connecting the lid top wall panel 325 to the lid front wall panel 322. The second portion 320 of the blanks 300 may further comprise a lid front wall inner panel 323 (or flap) for forming an inner layer of the front wall 122 of the lid 120 of the package 100. The lid front wall inner panel 323 may be connected to the lid front wall panel 322 (which may then be referred to as the lid front wall outer panel) by a fold line on an opposite side of the lid front wall panel 322 from the fold line connecting the lid front wall panel 322 to the lid top wall panel 325. Where a lid front wall inner panel 323 is present, the lid front wall panel 322 of the blanks 300 forms an outer layer of the front wall 122 of the lid 120 of the package 100. The second portion 320 of the blanks 300 further comprises a plurality of tabs including a first lid side wall tab 374, a first lid side top wall tab 372, a second lid side wall tab 376 and a second lid side top wall tab 378. The first and second lid side wall tabs 374 and 376 are connected to the lid rear wall panel 328 by respective fold lines on opposite sides of the lid rear wall panel 328. The first lid side top wall tab 372 is connected via a fold line to the first lid wall tab 374. The second lid side top wall tab 378 is connected via a fold line to the second lid side wall tab 376. As previously mentioned, the blanks 300 need not comprise a lid rear wall panel 328. In such a configuration, the first and second lid side top wall tabs 372 and 378 may be connected via fold lines to the first and second lid side wall panels 324 and 326 respectively, whilst the first and second lid side wall tabs 374 and 376 may be omitted.

The first portion 310 of the blanks 300 is connected to the second portion 320 of the blanks 300 by a crease line 330. When the crease line 330 is folded, the crease line 330 forms the lid-hinge 130 of the package 100. The crease line 330 is formed between the body rear wall panel 318 and the lid rear wall panel 328. However, where the blanks do not comprise the lid rear wall panel 328, the crease line 330 may instead be formed between the body rear wall panel 318 and the lid top panel 325.

The blanks 300 may further comprise a blank 310*a* for forming the inner frame 110*a* of the package 100, as shown in FIGS. 3A and 3B. The blank 310*a* for forming the inner frame 110*a* comprises at least an inner frame front wall panel 312*a* for forming the front wall 112*a* of the inner frame 110*a*. The blank 310 for forming the inner frame 110*a* may optionally further comprise additional panels, such as a first inner frame side wall panel 314*a* and a second inner frame side wall panel 316*a*. However, as discussed above, the package 100 need not comprise an inner frame 110*a* and therefore the blanks 300 for forming the package 100 need not comprise a blank 310*a* for forming the inner frame 110*a*.

The blanks 300 further comprise the engagement recess 150 and the locking tab 140.

The locking tab 140 may be formed either in the front wall of the body 110 of the package 100, in particular in the front wall panel 312*a* of the blank 310*a* for forming the inner frame 110*a* (as shown in FIG. 3A) or on the inner side of a panel for forming the front wall 112 of the lid 120 of the package 100, in particular on the inner side of the lid front wall inner panel 323 (as shown in FIG. 3B).

The engagement recess 150 may, preferably, be formed from an appropriately shaped cut-out in one of the panels of the blanks 300, as shown in both FIGS. 3A and 3B. The engagement recess 150 may be located on a panel for forming a front wall of the body 110 of the package 100, in particular in the front wall 312*a* of the inner frame blank 310*a*, or on the inner side of a panel for forming the front wall 112 of the lid 120 of the package 100, in particular on the inner side of the lid front wall inner panel 323, depending on the location on the locking tab 140. To form the package 100 from the blanks 300, each of the panels and tabs is folded about the respective fold lines which connect them with other panels and/or tabs of the blanks 300.

The body 110 of the package 100 is formed from the first portion 310 of the blanks 300 as follows. The first body side bottom wall tab 362 is attached to the inner side of the body bottom wall panel 317 at the point where they overlie when the respective fold lines connecting the first body side bottom wall tab 362 to the first body side wall tab 364 and the first body side wall tab 364 to the body rear wall panel 318 have been folded. Similarly, the second body side bottom wall tab 368 is also attached to the inner side of the body bottom wall panel 317 at the points where they overlie when the respective fold lines connecting the second body side bottom wall tab 368 to the second body side wall tab 366 and the second body side wall tab 366 to the body rear wall panel 318 have been folded. The first side wall panel 314 and the second side wall panel 316 may then be rotated about the respective fold lines connecting them to the body front wall panel 312 and attached to the first body side wall tab 364 and the second body side wall tab 366 respectively once the body front wall panel 312 has been folded about the fold line connecting it to the body bottom wall panel 317. With the tabs and panels of the first portion 310 of the blanks inter-attached in this manner, the structure of the body 110 of the package 100 is formed.

The lid 120 of the package 100 is formed from the second portion 320 of the blanks 300 as follows. The first lid side top wall tab 372 is attached to the inner side of the lid top wall panel 325 at the point where they overlie when the respective fold lines connecting the first lid side top wall tab 372 to the first lid side tab 374 and the first lid side tab 374 to the lid rear wall panel 328 have been folded. Similarly, the second lid side top wall tab 378, is also attached to the inner side of the lid top wall panel 325 at the point where they overlie when the respective fold lines connecting the second lid side top wall tab 378 to the second lid side tab 376 and the second lid side tab 376 to the lid rear wall panel 328 have been folded. The first lid side wall panel 324 and the second lid side wall panel 326 may then be folded about their respective fold lines connecting them to the lid front wall panel 322 and attached to the first lid side tab 374 and the second lid side tab 376 respectively once the lid front wall panel 322 has been folded about the folded line connecting it to the lid top wall panel 325. With the tabs and panels of the second portion 320 of the blanks 300 inter-attached in this manner, the structure of the lid 120 of the package 100 is formed. Where the blanks 300 comprise a lid front wall inner panel 323, this may be folded about the fold line that connects it to the lid front wall panel 322 and attached to the back of the lid front wall panel 322. The attachment of the lid front wall inner panel 323 to the back of the lid front wall panels 322 may be done in such a way as to leave a gap between the two panels.

The lid-hinge 130 of the package 100 is formed by creasing the crease line 330 thereby enabling the second portion 320 of the blanks 300 to rotate about the crease line 330 relative to the first portion 310 of the blanks 300.

The blanks 300 portion 310*a* for forming an inner frame 110*a* of the package 100 is formed by the panels thereof along fold lines connecting them to each other. The inner frame 110*a* is preferably formed around a bundle of smoking articles which are overwrapped in an inner liner (usually formed of paper or aluminium foil) which maintains the bundle of smoking articles in a parallelepiped unit prior to their insertion into the package. The body 110 of the package 100 is preferably then formed around the unit formed by the combination of the inner frame 110*a* and the overwrapped bundle of smoking articles. Once inserted in the body 110 of the package 100, at least part of the inner frame 110*a* is overlapped by the body 110 of the package 100 and the inner frame 110*a* is attached to the front and side walls 112, 114 and 116 of the body 110 of the package 100 at the places where the body 110 overlaps the inner frame 110*a*.

Whilst the blanks 300 shown in FIGS. 3A and 3B to form the package 100 have been shown with a particular size, shape and configuration of panels and tabs, it will be appreciated that minor changes may be made to these sizes, shapes and/or configuration as is well known in the field of geometric nets. For example, where a tab is used to connect one panel to another panel, generally that tab may be connected via a fold line to either of the two panels on the edge of that panel which is to be connected to the other panel. Similarly, a panel that is connected via a fold line to another panel on the blanks may be changed so that the panel is moved to another location on the blanks and a tab is used to connect the two panels together when the blanks are folded.

Figure 4A:
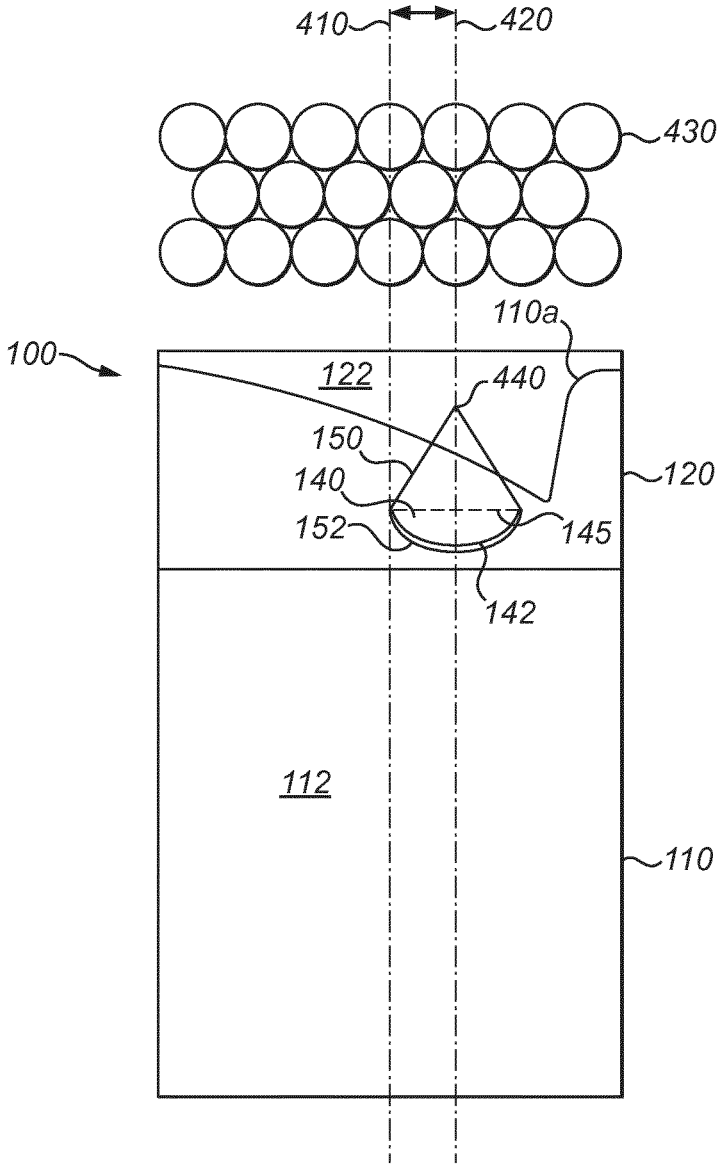
FIG. 4A shows a front view of the package of FIGS. 1A and 2A together with a representation of an arrangement of smoking articles inside the package.
Figure 4B:
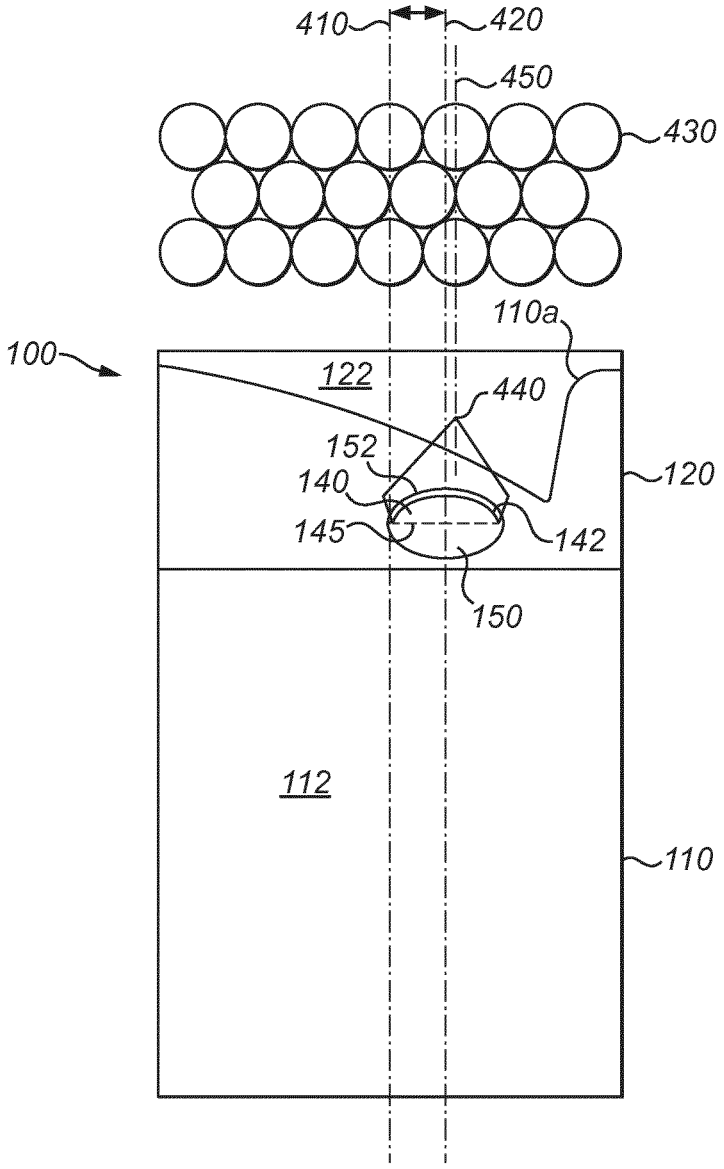
FIG. 4B shows a front view of the package of FIGS. 1B and 2B together with a representation of an arrangement of smoking articles inside the package.

FIGS. 4A and 4B show a front view of the previously described package 100. The package 100 is shown in FIGS. 4A and 4B together with a central longitudinal axis 410 which runs through the centre of the package 100. A second longitudinal axis 420 is also shown which runs through the centre of the locking tab 140. The second longitudinal axis 420 also runs through a centre of the portion of the engagement recess 150 which is involved in the mutual engagement with the locking tab 140 when the lid 120 is in the closed position. Preferably, the locking tab 140 and the engagement recess 150 are located such that the second longitudinal axis 420 is laterally offset from the central longitudinal axis 410. When a user intentionally opens the lid 120 of the package 100, they typically exert a force from the centre of the edge of the front wall 122 of the lid 120 of the package 100, approximately at the point where the central longitudinal axis 410 meets the edge of the front wall 122. When a force is applied to the centre of the bottom edge of the front wall 122 of the lid 120 of the package 100, the front wall 122 of the lid 120 may deform slightly providing an additional lever action to aid the user in overcoming the bias of the locking mechanism and open the package 100.

Figure 5A:
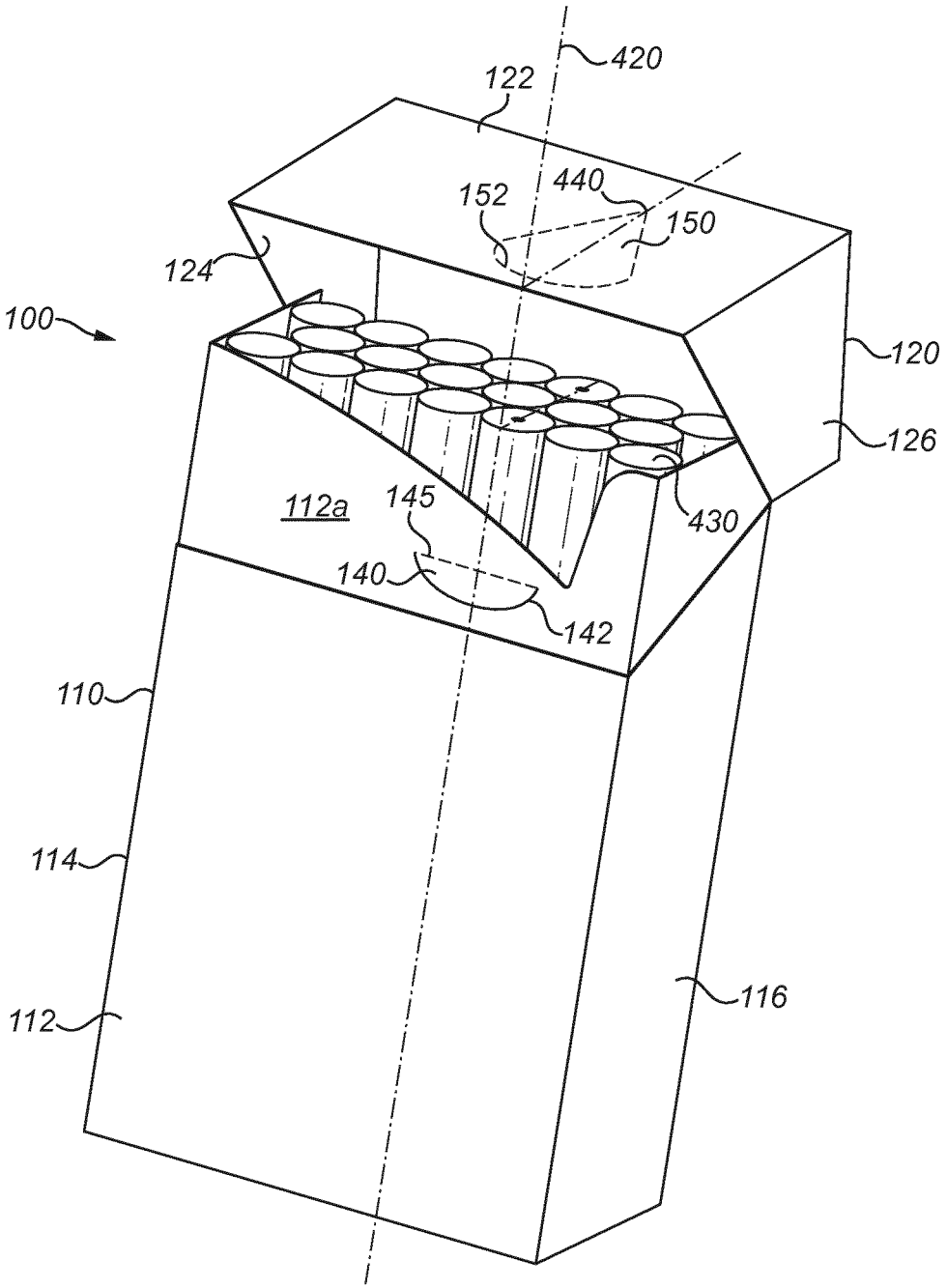
FIG. 5A shows a perspective view of the package of FIGS. 1A, 2A and 4A together with smoking articles arranged inside the package.
Figure 5B:
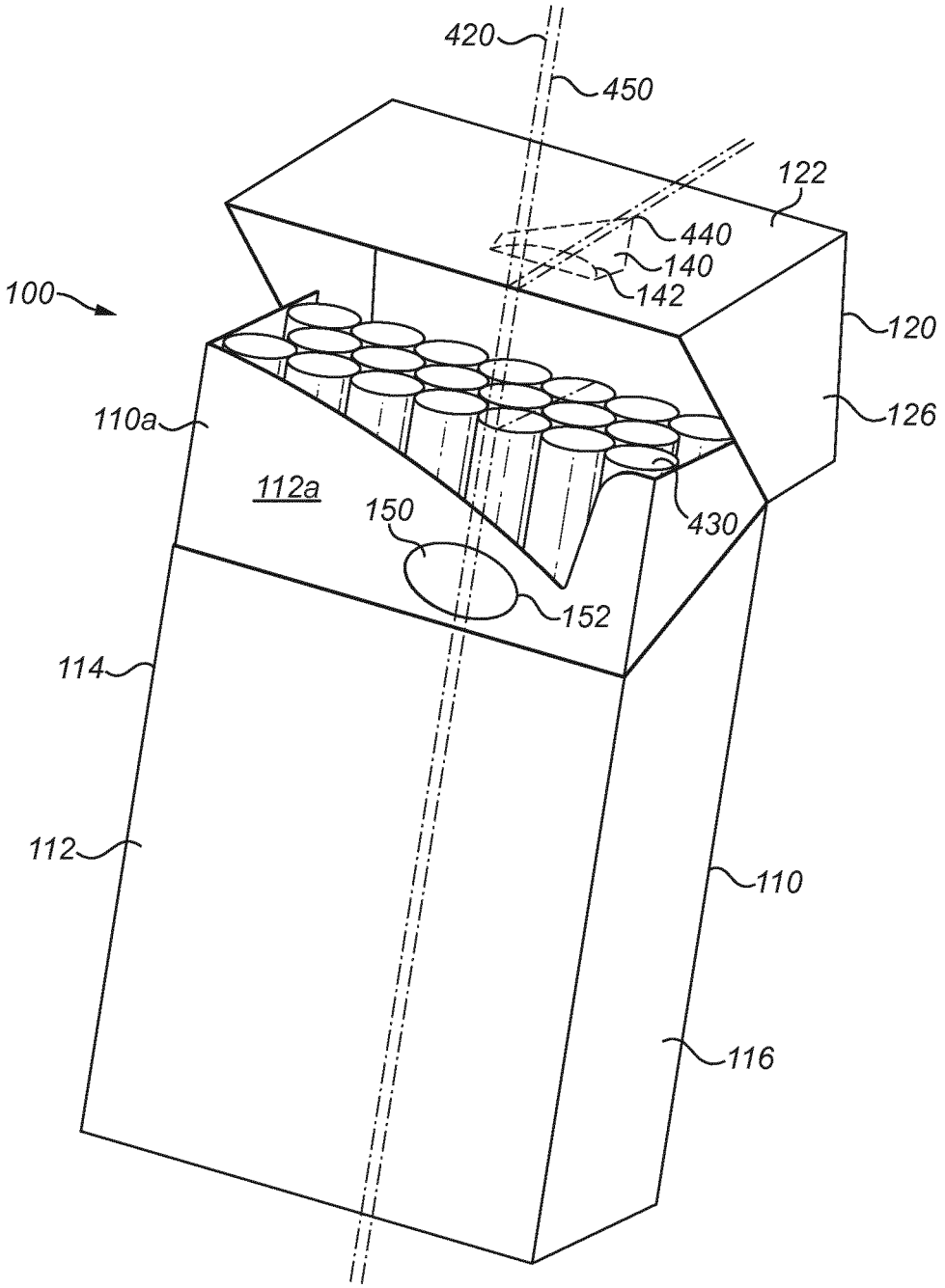
FIG. 5B shows a perspective view of the package of FIGS. 1B, 2B and 5B together with smoking articles arranged inside the package.

FIGS. 4A and 4B further show a representation of a plurality of smoking articles 410 that may be contained in the package 100. The arrangement of the plurality of smoking articles 410 is shown above the package 100 merely for the purposes of demonstrating the alignment between various features of the package 100 and the smoking articles 410 that the package 100 may contain. The arrangement of the smoking articles 410 shown is the arrangement of the smoking articles 410 as they would appear inside the package 100 when viewed from the top of the package 100 (i.e. from the open top end 115 of the body 110). It will be appreciated that in normal use, the smoking articles 410 would be contained inside the package 100 as illustrated by FIGS. 5A and 5B, which show a perspective view of the package 100 according to the present invention with the lid 120 of the package 100 in an open position and the smoking articles 410 arranged inside the package 100.

A typical arrangement of smoking articles 430 consists of a number of smoking articles 430 arranged in one or more rows. A front row of smoking articles 430 may lie along the front wall 112 of the body 110 of the package 100. Due to the cylindrical nature of most smoking articles 410, alternate rows in the arrangement of smoking articles 410 may be offset to improve tessellation of the smoking articles 410 and therefore improve packing density. A common (but not exclusive) arrangement of smoking articles is the 7-6-7 arrangement as shown in FIGS. 4A and 4B in which the front and rear row consist of 7 smoking articles whilst a middle row consists of 6 smoking articles. It will, however, be appreciated that different arrangements (and numbers) of smoking articles 410 may be used.

It is desirable to make the package 100 fit as closely to the contents as possible so as to minimise wasted space in the package and make the package more portable. As a result, the dimensions of the package 100 may be such that when the lid 120 of the package is moved from the open position to the closed position, the inner side of the front wall 122 of the lid 120 of the package 100 lightly brushes the smoking articles 430 that are stored in the package. This light brushing from the inner side of the front wall 122 of the lid 120 may slightly compress the smoking articles 430 contained in the package 100, but will not cause any substantial damage to the smoking articles 430. However, the location of either the locking tab 140 or the engagement recess 150 on the inner side of the front wall 122 of the lid 120 of the package 100 may result in smoking articles 430 being snagged as the lid is closed, possibly resulting in tearing or more significant deformation of the smoking articles 430. Preferably, whichever of the locking tab 140 or the engagement recess 150 that is formed on the inner side of the front wall 122 of the lid 120 is formed by the removal (i.e. cut-out) of material from the inner side of the front wall 122, so that the feature does not protrude from the inner side of the front wall 122 to the same extent. However, snagging of smoking articles 430 may still occur due to the close fitting nature of the smoking articles 430 in the package 100. In order to minimise the problem of snagging, preferably the shape of the cut-out portion which forms whichever of the locking tab 140 or the engagement recess 150 that is located on the inner side of the front wall 122 of the lid 120 tapers to a point to form an apex 440. This apex 440 is located towards the top of the front wall 122 of the lid 120 with the cut-out portion being formed underneath the apex 440. This apex 440 may fall on the same second longitudinal axis 420 that runs through a centre of the locking tab 140 and through a centre of the portion of the engagement recess 150 which is involved in the mutual engagement with the locking tab 140 when the lid is in the closed position, as shown in FIG. 4A. However, this need not be the case and this apex 440 may be located on a third longitudinal axis 450, as illustrated in FIG. 4B. Although FIG. 4A has been shown with the apex 440 on the same axis 420 that runs through the centre of the locking tab and through a centre of the portion of the engagement recess 150 which is involved in the mutual engagement with the locking tab 140 when the lid is in the closed position, the apex 440 in the package 100 shown in FIG. 4A could be on a different third longitudinal axis 450, as illustrated in FIG. 4B. Similarly, the package 100 shown in FIG. 4B could have an a cut-out portion with an apex 440 that is on the same axis 420 that runs through the centre of the locking tab and through a centre of the portion of the engagement recess 150 which is involved in the mutual engagement with the locking tab 140 when the lid is in the closed position. The apex 440 of the cut-out portion is preferably located such that the longitudinal axis 420 or 450 that passes through the apex 440 is aligned with the center point of a smoking article 430 in the front row of the arrangement of smoking articles. This location of the apex 440 means that the edges of the cut-out portion lie outside of the circumference of substantially circular top of the smoking article 430 as the lid 120 is closed. This means that any contact between the smoking article 430 and the cut-out portion during the closing of the lid 120 will not involve the edges of the cut-out portion, thereby preventing the smoking article 430 from snagging on the cut-out portion.

As discussed above, the longitudinal axis 420 which runs through the centre of the locking tab 140 and the centre of the portion of the engagement recess 150 which is involved in the mutual engagement with the locking tab 140 when the lid 120 is in the closed position need not lie on the same longitudinal axis as the longitudinal axis 450 which runs through the apex 440 of the cut-out portion and may instead be laterally offset from such an axis 450. This lateral displacement of the locking tab 140 and the main part of the engagement recess 150 (i.e. the part of the engagement recess 150 that is involved in the mutual engagement with the locking tab 140 when the lid 120 is in the closed position, enables other structural considerations to be taken into account. As an example, in the package 100 shown in FIGS. 4B and 5B (which also corresponds to the package 100 shown in FIGS. 1B and 2B), the inner frame 110*a* has an irregular shape formed along the top edge. In the package 100 shown in FIGS. 4B and 5B, the engagement recess 150 is formed on the inner frame 110*a*. If the engagement recess 150 were to be located on the same axis 450 that passes through the apex 440 of the cut-out portion, there would be very little material separating the engagement recess 150 from the top of the inner frame 110*a* (due to the irregular shape of the inner frame 110*a*), resulting in a weak engagement recess 150 that would likely be damaged (e.g. by tearing) relatively quickly. However, according to the present invention, the engagement recess 150 may be offset from the axis 450 which runs through the apex 440 of the cut-out portion on the inner side of the lid 120 of the package 100, thereby allowing the engagement recess 150 to be located in a position further away from the irregular top edge of the inner frame 110*a*, thereby resulting in a stronger and more resilient engagement recess 150. However, because the axis 450 which runs through the apex 440 of the cut-out portion still aligns with the center of a smoking article 430 in the front row of the arrangement of smoking articles 430 in the package 100, snagging of the smoking article 430 may still be prevented.

The invention claimed is:

1. A package for storing smoking articles, the package comprising:

a body comprising a plurality of walls defining a volume for storing the smoking articles, including a front wall and a rear wall substantially opposite the front wall, and an opening for accessing the volume and inserting or removing any smoking articles stored therein;

a lid for closing the opening of the body, the lid comprising a plurality of walls and being rotatable relative to the rear wall of the body about a lid hinge, allowing the lid to be moved between a closed position and an open position;

a locking tab;

an engagement recess for engaging with the locking tab when the lid is in the closed position;

wherein the locking tab is formed in one of either (a) the front wall of the body of the package or (b) an inner side of a front wall of the lid, and is rotatable relative to the body or the lid about a locking tab hinge that extends in a direction parallel to the lid hinge, and the engagement recess is located on the other one of either (a) the front wall of the body of the package, or (b) the inner side of the front wall of the lid;

wherein the locking tab and the engagement recess each have a respective engagement edge for mutual engagement between the locking tab and the engagement recess, the engagement edge of both the locking tab and the engagement recess follows a curved line, and the curved line of the engagement edge of each of the locking tab and the engagement recess follows a respective elliptical shape having a major axis extending parallel to the lid hinge, wherein the locking tab and the engagement recess are arranged such that the locking tab fits into the engagement recess in the closed position of the lid and engages with the engagement recess in a hooking fashion upon opening of the lid towards the open position, wherein the engagement edge of the locking tab is inscribed in a first ellipse, the engagement edge of the engagement recess is inscribed in a second ellipse, and the locking tab and the engagement recess are arranged such that, when the lid is in the closed position, the major axis of the first ellipse is coaxial and smaller than the major axis of the second ellipse, and wherein the locking tab and the engagement recess are arranged such that as the lid is moved from the closed position to the open position, a rate at which contact points between the engagement edge of the locking tab and the engagement edge of the engagement recess move away from the locking tab hinge changes at differing rates, such that a force required to rotate the locking tab decreases.

2. A package according to claim 1, wherein the engagement edge of the engagement recess follows a first curved line and the engagement edge of the locking tab follows a second curved line which is parallel to and offset in a longitudinal direction of the package from the first curved line when the lid is in the closed position.

3. A package according to claim 1, wherein each end of the engagement edge is located at a different respective end of a major axis of the first ellipse and a locking tab hinge extends along the major axis of the first ellipse.

4. A package according to claim 1, wherein the engagement edge of the engagement recess extends along at least half of the second ellipse between vertices on a major axis of the second ellipse and wherein the major axis of the second ellipse is parallel to the locking tab hinge when the lid is in the closed position.

5. A package according to claim 4, wherein the engagement edge of the engagement recess extends to, and is fully delimited by, the second ellipse.

6. A package according to claim 1, wherein the locking tab is located on the front wall of the body and connected to the front wall of the body by a fold line and wherein the engagement recess is located on the inner side of the front wall of the lid.

7. A package according to claim 1, wherein the engagement recess is located on the front wall of the body and is formed by a cut-out therein and wherein the locking tab is formed on the inner side of the front wall of the lid.

8. A package according to claim 1, further comprising an inner frame and wherein the front wall of the body of the package comprises a front wall of the inner frame.

9. A blank or set of blanks for forming a package for storing smoking articles, the blank or set of blanks comprising:

a plurality of panels for forming a body and a lid of the package, including a front wall panel for forming a front wall of the body and a rear wall panel for forming a rear wall of the body;

a crease line for forming a hinged connection between the lid and the rear wall panel, the hinged connection allowing the lid to be moved between the closed position and the open position;

wherein a locking tab is formed in one of either (a) the front wall panel or (b) a panel for forming an inner side of a front wall of the lid, and is rotatable relative to the body or the lid about a locking tab hinge that extends in a direction parallel to the crease line, and an engagement recess is formed on the other one of either (a) the front wall panel, or (b) the inner side of the front wall of the lid;

wherein the locking tab and the engagement recess are located to allow mutual engagement between respective engagement edges of the locking tab and the engagement recess and are formed such that the engagement edge of both the locking tab and the engagement recess follows a curved line, and the curved line of the engagement edge of each of the locking tab and the engagement recess follows a respective elliptical shape having a major axis extending parallel to a lid hinge of the package that couples the lid to the body, wherein the locking tab and the engagement recess are arranged such that the locking tab fits into the engagement recess in the closed position of the lid and engages with the engagement recess in a hooking fashion upon opening of the lid towards the open position, wherein the engagement edge of the locking tab is inscribed in a first ellipse, the engagement edge of the engagement recess is inscribed in a second ellipse, and the locking tab and the engagement recess are arranged such that, when the lid is in the closed position, the major axis of the first ellipse is coaxial and smaller than the major axis of the second ellipse, and wherein the locking tab and the engagement recess are arranged such that as the lid is moved from the closed position to the open position, a rate at which contact points between the engagement edge of the locking tab and the engagement edge of the engagement recess move away from the locking tab hinge changes at differing rates, such that a force required to rotate the locking tab decreases.

10. A method of forming a package comprising folding the blank or set of blanks of claim 9.

11. A blank for forming a package for storing smoking articles, the blank comprising:

a plurality of panels for forming a body and a lid of the package, the body comprising a plurality of walls defining a volume for storing the smoking articles, including a front wall and a rear wall substantially opposite the front wall, and an opening for accessing the volume and inserting or removing any smoking articles stored therein, the lid for closing the opening of the body, the lid comprising a plurality of walls, the plurality of panels including a front wall panel for forming the front wall of the body and a rear wall panel for forming the rear wall of the body;

a crease line for forming a hinged connection between the lid and the rear wall panel, the hinged connection allowing the lid to be moved between a closed position and an open position;

wherein a locking tab is formed in one of either (a) the front wall panel or (b) a panel for forming an inner side of a front wall of the lid, and is rotatable relative to the body or the lid about a locking tab hinge that extends in a direction parallel to the crease line, and an engagement recess for engaging with the locking tab when the lid is in the closed position is formed on the other one of either (a) the front wall panel, or (b) the inner side of the front wall of the lid;

wherein the locking tab and the engagement recess are located to allow mutual engagement between respective engagement edges of the locking tab and the engagement recess and are formed such that the engagement edge of both the locking tab and the engagement recess follows a curved line, and the curved line of the engagement edge of each of the locking tab and the engagement recess follows a respective elliptical shape having a major axis extending parallel to the lid hinge, wherein the locking tab and the engagement recess are arranged such that the locking tab fits into the engagement recess in the closed position of the lid and engages with the engagement recess in a hooking fashion upon opening of the lid towards the open position, wherein the engagement edge of the locking tab is inscribed in a first ellipse, the engagement edge of the engagement recess is inscribed in a second ellipse, and the locking tab and the engagement recess are arranged such that, when the lid is in the closed position, the major axis of the first ellipse is coaxial and smaller than the major axis of the second ellipse, and wherein the locking tab and the engagement recess are arranged such that as the lid is moved from the closed position to the open position, a rate at which contact points between the engagement edge of the locking tab and the engagement edge of the engagement recess move away from the locking tab hinge changes at differing rates, such that a force required to rotate the locking tab decreases.

* * * * *